US006585824B2

(12) United States Patent
Katagiri et al.

(10) Patent No.: US 6,585,824 B2
(45) Date of Patent: Jul. 1, 2003

(54) COATING SYSTEM

(75) Inventors: Yoshinobu Katagiri, Minami-Ashigara (JP); Masahiro Ishino, Minami-Ashigara (JP); Yoshio Nakano, Minami-Ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/837,229

(22) Filed: Apr. 19, 2001

(65) Prior Publication Data

US 2001/0032586 A1 Oct. 25, 2001

(30) Foreign Application Priority Data

Apr. 19, 2000 (JP) ..... 2000-117843

(51) Int. Cl.[7] ..... B05C 11/00

(52) U.S. Cl. ..... 118/698; 118/696

(58) Field of Search ..... 118/712, 695, 118/698, 325, DIG. 4, DIG. 5, 410, 697, 696, 707

(56) References Cited

U.S. PATENT DOCUMENTS 6,228,168 B1 * 5/2001 Johnson

FOREIGN PATENT DOCUMENTS

JP 1-257330 * 10/1989

* cited by examiner

*Primary Examiner*—Brenda A. Lamb
(74) *Attorney, Agent, or Firm*—Sughrue Mion, PLLC

(57) ABSTRACT

A coating system selecting kinds of coating heads and operation sequences with no errors even when two or more kinds of coating heads are used in exchange in a single coating line. The coating system uses an automatic discriminating device which automatically discriminates at least kinds of a plurality of coating heads used in exchange in a single coating line, thereby discriminating the kind of the coating head which is set in the coating line.

24 Claims, 2 Drawing Sheets

COATING SYSTEM

BACKGROUND OF THE INVENTION

1. Field of the Invention

The present invention relates to a coating system, and more specifically a coating system which coats a continuously running belt like substrate (hereinafter referred to as a web) with liquid composites (hereinafter referred to as coating liquids) using coating heads in particular in manufacture of films for photographic sensitized materials, photographic printing paper or the like.

2. Description of the Related Art

Precision coating methods for coating webs using coating dies are represented by a slot coating method, a slide bead coating method and a curtain coating method. Out of these coating methods, an optimum method is selected dependently on characteristics of a coating liquid applied on a product, for example, a water-based coating liquid or an organic solvent-based coating liquid, a number of coating liquid film layers, a viscosity of a coating liquid, a coating thickness, a coating speed or the like. Used for these coating methods are different coating heads and different kinds of coating operations respectively. In the slot coating method or the slide coating system method, for example, coating is started by moving a coating head or a backup roller opposed thereto from a standby position to a coating position. In the curtain coating method, on the other hand, it is necessary to move a coating head from a preparatory adjusting position to a coating position, and receive a coating liquid with a coating start plate before coating and operate a coating system by pulling out the coating start plate at a measured timing at a coating time. In order to measure the timing accurately in this case, the coating start plate may be pulled out with the coating head once stopped and then the coating head may be moved again to a final coating position. A moving speed and a moving distance of the coating head or the backup roller optimum for starting coating are different dependently on the coating methods. For a certain coated product, a conveying speed and a liquid flow rate at a coating start time and air conditioning conditions at a drying step may be changed from those for a portion coated in a steady state in order to prevent a conveying roller from being contaminated by a leading end which is coated thick at the coating start time and not dried. For the slot coating method or the slide bead coating method in which a gap is narrow between the coating head and the web, it is general to slightly evacuate the coating head or the backup roller when a web joint portion passes during continuous coating, thereby preventing a coating film from being remarkably disturbed by passage of the joint portion. However, such evacuation is not necessary for the curtain coating method in which a tip lip of the coating head is apart from the web, and a movement of the coating head rather causes disturbance of the coating film.

It is desirable that the coating methods which require different conditions and operations for coating as described above are used in separate coating lines.

However, it is inevitable in a certain case to use these coating methods in a single coating line from an economical viewpoint and it is necessary in this case to use a plurality of different kinds of coating heads in exchange in the single coating line. Since the coating heads are exchanged by an operator, it is possible that the operator erroneously selects a coating head to be exchanged or erroneously sets an operation sequence of the coating system for a correct coating head. If a coating head is erroneously selected or an operation sequence is erroneously set, not only coating will be unsuccessful but also there will be posed problems that the coating head will strike against the backup roller, thereby breaking appliances such as the coating head, the backup roller and the like.

SUMMARY OF THE INVENTION

The present invention has been achieved in view of such circumstances and has an object to provide a coating system and a coating method which selects kinds of coating heads and operation sequences with no errors even when two or more kinds of coating heads are used in exchange in a single coating line.

In order to accomplish the above described object, the present invention is directed to a coating system, comprising: a single coating line configured to coat a running web with a coating liquid using a plurality of different kinds of coating heads in exchange; and an automatic discriminating device which automatically discriminates at least kinds of the plurality of coating heads, the automatic discriminating device being disposed in the coating line.

According to the present invention, the automatic discriminating device is provided for automatically discriminating at least the kinds of the plurality of coating heads used in exchange in the single coating line, thereby the coating system is free from erroneous discrimination of the kind of the coating head which is set in the coating line.

Preferably, the coating system further comprises a control device which controls the coating line, the control device selecting an operation sequence corresponding to the automatically discriminated coating head out of a plurality of operation sequences according to an automatic discrimination result of the kind of the coating head set in the coating line.

Preferably, the control device comprises: an input device which allows an operator to input the operation sequence; and a check mechanism which checks whether or not the operation sequence inputted through the input device correctly corresponds to the kind of the coating head automatically discriminated by the automatic discriminating device. Accordingly, the coating system is capable of preventing an error that the kind of a coating head does not correspond to an operation sequence even when the operator inputs the operation sequence.

Preferably, the automatic discriminating device comprises: data carriers, each of which is disposed for each of the plurality of coating heads and has kind information of each of the plurality of coating heads; and a reading device which reads the information of the data carrier.

Preferably, each of the data carriers has coating condition information for each of the plurality of coating heads in addition to the kinds information of the coating heads. Thus, it can prevent an error that coating conditions of the coating heads do not correspond to the operation sequence, for example, even when an identical kind of coating heads, that is, coating heads for an identical coating method but configured for different coating conditions such as a coating width are used.

Preferably, the reading device comprises a read/write antenna, and the information set in the data carrier with one of a microwave system and an optical system is noncontactly read by the read/write antenna. Thus, it is free from limitation to locations for installing the data carrier and the read/write antenna.

Preferably, the automatic discriminating device comprises: bar codes, each of which is disposed for each of the plurality of coating heads and has at least kind information of each of the coating heads; and a bar code reader which reads information of the bar codes.

Preferably, the automatic discriminating device comprises: objects, each of which is disposed for each of the plurality of coating heads and has a form different dependently on each of the plurality of coating heads; and one of an electromagnetic proximity sensor, an ultrasonic sensor, a photoelectric sensor and a CCD camera which detects one of presence, absence and the forms of the objects.

Preferably, the automatic discriminating device comprises: one of an electromagnetic proximity sensor, an ultrasonic sensor, a photoelectric sensor and a CCD camera which determines forms of the plurality of coating heads.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

Description will be made of preferable embodiments of the coating system according to the present invention with reference to the accompanying drawings.

Figure 1:
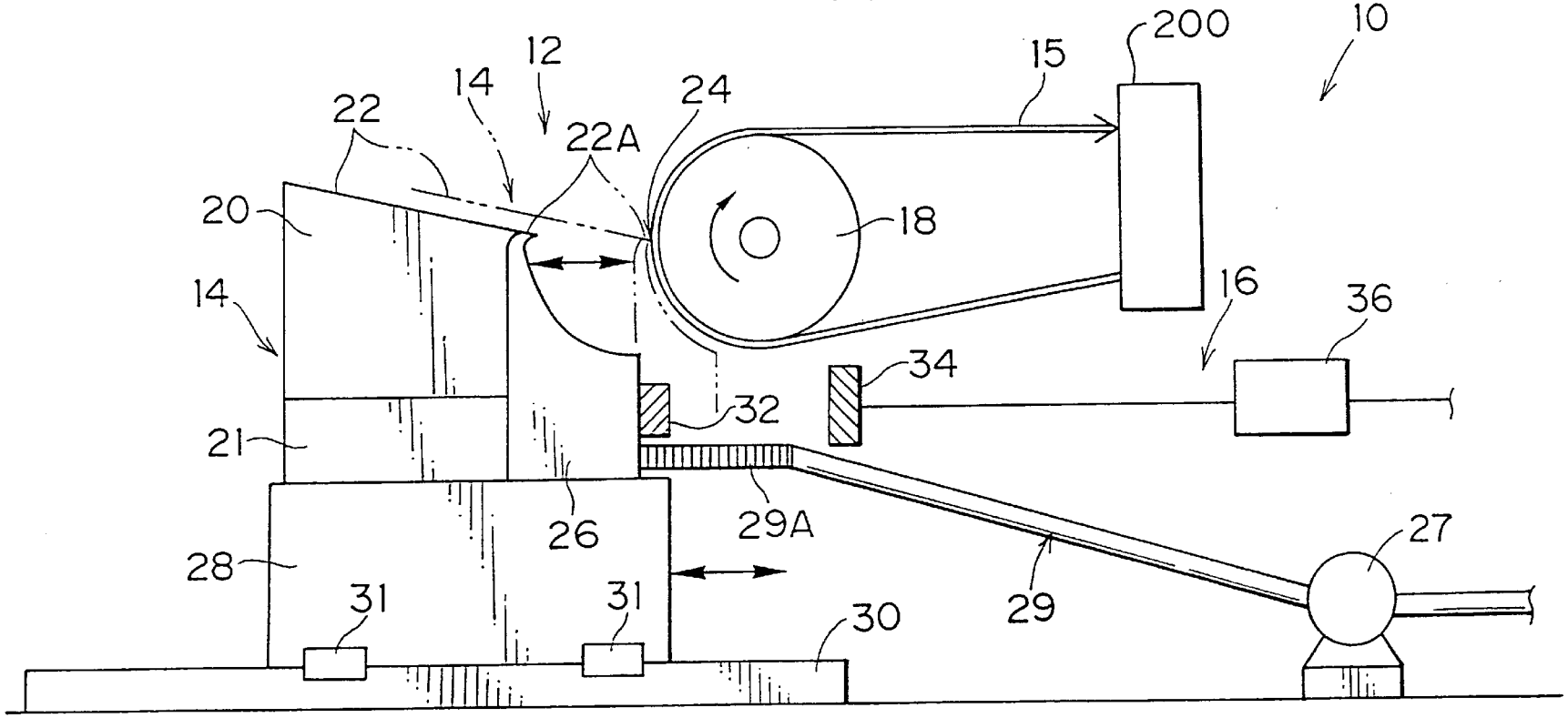
FIG. 1 is a schematic view of a coating system according to an embodiment of the present invention wherein a coating head for slide bead coating is set in a coating line.

FIG. 1 is a schematic view showing a configuration of the coating system according to an embodiment of the present invention.

The coating system 10 comprises a coating line 12, which is configured to allow a plurality of different kinds of coating heads to be exchanged, and an automatic discriminating device 16, which automatically discriminates at least a kind of a coating head 14 set in the coating line 12.

The coating line 12 comprises the coating head 14, a backup roller 18, which is disposed in opposition to the coating head 14 and is engaged with a running web 15, and a controller (not shown), which controls an operation of the coating line 12. The running web 15 is moved by a web driving device 200.

The coating head 14 is an assembly of a coating die 20, a stand 21 for fixing the coating die 20, and a depressurized chamber 26 for stabilizing a coating liquid bead portion (coating liquid bridging portion) formed between a tip portion 22A of a slide surface 22 of the coating die 20 and a web 15. The coating head 14 as a whole is detachably supported on a moving table 28 with bolts (not shown). A detachably supporting method is not limited to the bolts but any method may be used so far as it can attach and detach the coating head 14 easily.

The moving table 28 is slidably mounted on two rails 30, which are laid toward the backup roller 18, through linear bearings 31. The moving table 28 is moved toward and away from the backup roller 18 by a driving mechanism (not shown) such as a hydraulic cylinder.

The automatic discriminating device 16 comprises a data carrier 32 attached to the coating head 14, a read/write antenna 34, which noncontactly (i.e., without touching the data carrier 32) reads information written in the data carrier 32, and a discriminator 36, which discriminates read data. The data carrier 32 is preliminarily set so as to transmit an identification signal that is different for each coating head 14. On the other hand, at the time when the coating head 14 is mounted on the moving table 28, the read/write antenna 34 reads the information from the data carrier 32, and the discriminator 36 automatically discriminates one of a plurality of coating heads 14 that is currently set. The automatic discriminating device 16 is not limited to the data carrier 32, the read/write antenna 34 and the discriminator 36, but may be composed of bar codes provided on the coating heads 14 and a bar code reader, which reads information of the bar codes. Furthermore, the automatic discriminating device 16 may include an electromagnetic proximity sensor, an ultrasonic sensor, a photoelectric sensor or a CCD camera or the like and another apparatus so far as the apparatus has a similar function, in order to determine shapes of the coating heads 14 or to detect presence, absence or forms of objects that can be attached to the coating heads to represent the kinds of the coating heads. In addition, the discriminator 36 may not be disposed as a separate device but built in the controller as described later.

The information which is automatically discriminated by the automatic discriminating device 16 is outputted to the controller for controlling the coating line, and the controller automatically selects an operation sequence corresponding to the coating head 14 currently mounted on the moving table 28 out of base data of a plurality of preliminarily inputted operation sequences for the coating heads on the basis of the automatically discriminated information. The operation sequence includes, for example, a moving distance and a speed setting of the moving table 28, which moves the coating head 14 close to the backup roller 18 at a coating start time, a start timing for a depressurizing blower 27 communicated with the depressurized chamber 26, or the like. In the case where the web 15 is to be charged with a wire or a brush (not shown) for enhancing a coating property, the controller selects also an operation sequence for controlling a voltage application timing and a voltage to be applied. On the basis of the set operation sequence, the controller performs controls of displacement of the moving table 28 from standby position (position of the coating head 14 traced in solid lines in FIG. 1) to a coating position (position of the coating head 14 traced in alternate long and two short dashes lines in FIG. 1) and other operations, thereby starting coating. A part 29A of a pressure hose 29, which connects the depressurized chamber 26 to the depressurizing blower 27, is expansible or fitted so that the pressure hose 29 can cope with the displacement of the table 28.

Though description has been made above of the controller which automatically selects the corresponding operation sequence on the basis of the information of the coating head 14 automatically discriminated by the automatic discriminating device 16, the coating system may be configured so that an operator sets an operation sequence into the controller through an input device each time. In this case, it is preferable to dispose in the controller a check mechanism that checks whether or not the operation sequence inputted through the input device correctly corresponds to the kind of the coating head 14 automatically discriminated by the automatic discriminating device 16. The coating system 10 is configured to initiate the operation sequence only when the check mechanism confirms that the operation sequence corresponds correctly to the kind of the coating head 14 automatically discriminated by the automatic discriminating device 16 and emit a warning when the operation sequence does not correspond to the kind of the coating head 14. The check mechanism can function properly, for example, when standard data of the coating heads 14 and correct operation sequences corresponding to the coating heads 14 is preliminarily inputted into the controller and comparing the coating head 14 actually set in the coating line 12 with inputted data of the inputted operation sequence. Furthermore, buzzer sounding or warning lamp flickering may be used as a warning method.

Though the embodiment has been described as an example wherein the coating head 14 is moved toward and away from the fixed backup roller 18, it is possible to fix the coating head 14 and move the backup roller 18 toward and away from the coating head 14. Furthermore, the information written in the data carrier 32 is not limited to the kinds of the coating heads 14, and coating conditions for the coating heads 14 may be written as the information in the data carrier 32. Thereby, this information is applicable to discrimination of an identical kind of the coating heads 14, that is, coating heads for an identical coating method but configured for different coating conditions such as coating widths.

Description will be made of operations of the coating system 10 configured as described above taking an example where a slide bead coating system is switched to a curtain coating system in the single coating line 12.

The operator mounts and fixes the coating head 14 for slide bead coating on the moving table 28 at the standby position as shown in FIG. 1. When the coating head 14 is mounted and fixed, the read/write antenna 34 reads a signal from the data carrier 32 disposed on the coating head 14, and the discriminator 36 discriminates the coating head 14 for the slide bead coating. This discrimination information is outputted to the controller. On the basis of this discrimination information, the controller automatically selects the operation sequence corresponding to the coating head 14 for the slide bead coating, thereby setting a moving distance, a moving speed or the like of the moving table 28 before coating start, at a coating start time and at a coating termination time. One to twenty kinds of coating liquids supplied to the coating die 20 flow down along the slide surface 22 while forming one or multiple layers, whereas the web 15 to be coated with the coating liquids runs in a direction indicated by an arrow in FIG. 1 while being engaged with the backup roller 18. At the coating start time, the moving table 28 is moved from the standby position toward the backup roller 18 and the blower 27 is started to depressurize an interior of the depressurized chamber 26. The blower 27 may be started when the coating head 14 is mounted. When the web is charged for aid of coating, a voltage application timing, a voltage to be applied or the like are automatically set and controlled on the basis of the discrimination information of the coating head 14. Accordingly, the coating head 14 that is set in the coating line 12 is correctly positioned, and the coating liquids flowing down along the slide surface 22 form a bead of the coating liquids between the tip portion 22A of the slide surface and the web 15, whereby the coating liquids are applied over the web 15 by way of this bead.

Figure 2:
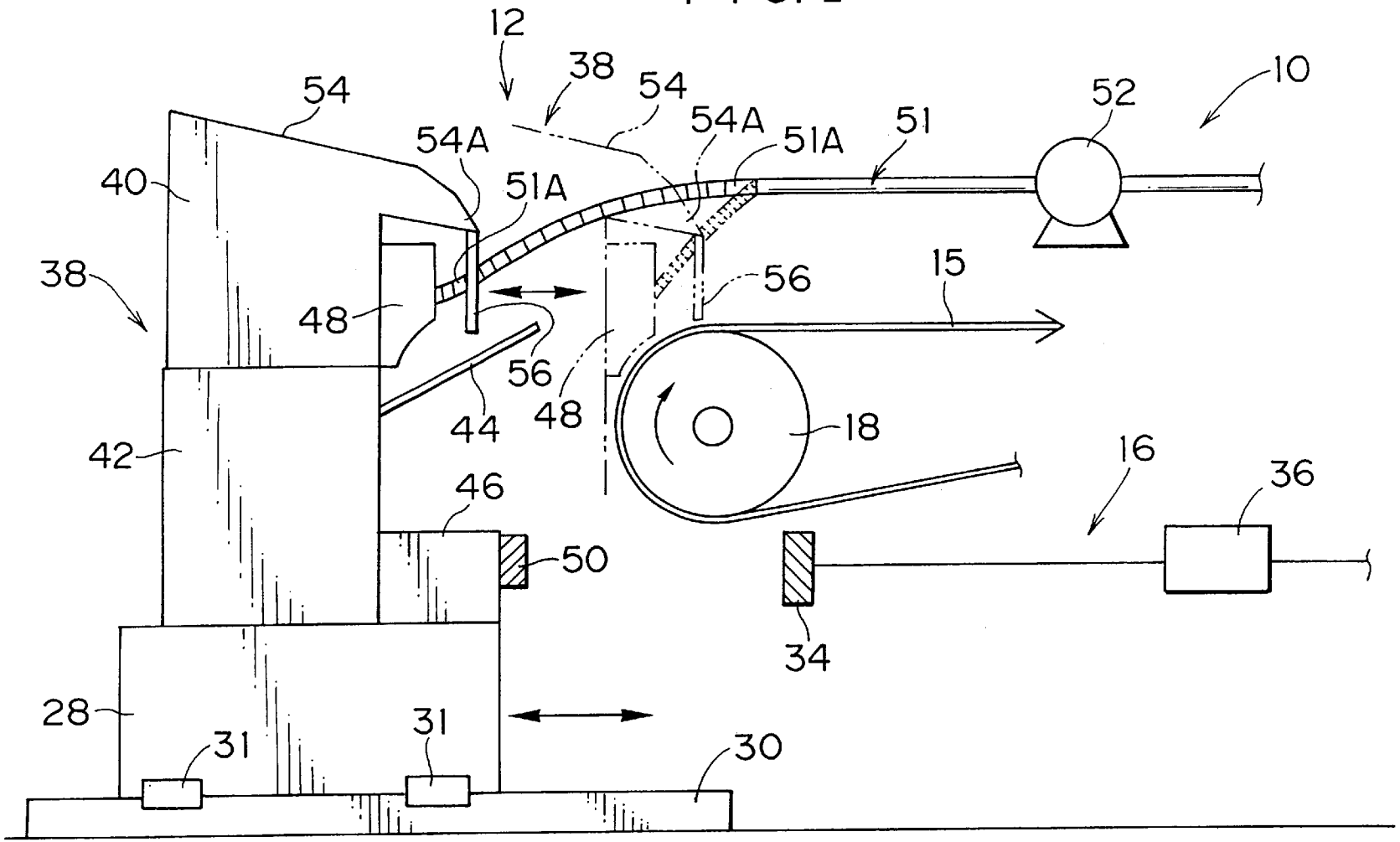
FIG. 2 is a schematic view wherein a coating head for curtain coating is set in the coating line instead of the coating head for slide bead coating.

After completing coating in the slide bead method, the moving table 28 is moved to the standby position, and the operator exchanges the coating head 14 for the slide bead coating with a coating head 38 for curtain coating shown in FIG. 2. The coating head 38 for the curtain coating is set on the moving table 28 accordingly. When several coating heads are to be used in an identical coating line as in the coating system according to the present invention, it is convenient to form the coating head 38 for the curtain coating by assembling a coating die 40, a rack 42, a coating start plate 44, a liquid receiving box 46 and an air shield 48 into a single unit.

Then, the read/write antenna 34 reads a data carrier 50 disposed on the exchanged coating head 38, and the discriminator 36 discriminates the coating head 38 for the curtain coating. This discrimination signal is outputted to the controller.

On the basis of this discrimination signal, the controller selects the operation sequence corresponding to the coating head 38 for the curtain coating, thereby setting and controlling a moving distance and a moving speed of the moving table 28 before a coating start, at a coating start time and at a coating termination time, an operation timing of the coating start plate 44, a depressurized degree in the air shield 48, a start timing of the depressurizing blower 52 or the like. When the web 15 is charged for aid of coating like that for the slide bead coating, a voltage application timing, a voltage to be applied or the like are automatically set and controlled on the basis of the discrimination signal of the coating head 38. A part 51A of a pressure hose 51, which connects the air shield 48 to the depressurizing blower 52, is expansible or fitted as in the case of the coating head 14 for the slide bead coating.

Describing a general control sequence before the coating start to the coating start time in the curtain coating method, the moving table 28 is first moved from the standby position before the coating start (position of the coating head 38 traced in solid lines in FIG. 2) to a coating position (position of the coating head 38 traced in alternate long and two short dashes line in FIG. 2) and positioned so that coating liquids freely drop from a tip portion 54A of a slide surface of the coating head 38 onto the web 15 running along the backup roller 18. Then, one to twenty kinds of coating liquids are supplied to a coating die 40 and allowed to flow down a slide surface 54, and the coating start plate 44 is disposed between the tip portion 54A of the slide surface and the web 15. Accordingly, the coating liquids freely drop from the tip portion 54A of the slide surface onto the coating start plate 44, thereafter being received and recovered by the liquid receiving box 46. At this step, edge guides 56 and 56 which are disposed on both sides of the coating liquids freely falling like a curtain film hold both ends of the falling liquid film to prevent the liquid from contracting.

When the curtain film of the coating liquids freely falling from the tip portion 54A of the slide surface is formed stably, the coating start plate 44 is pulled out so that the freely falling coating liquids strike against the web 15. The curtain coating is thus started. At the coating start time, the air shield 48 (a depressurized chamber type air shield is shown in FIG. 2 for example) is started to exclude air accompanying the running web 15 during the coating.

In addition, it is possible to form the curtain film in a condition where the coating head 38 is at the standby position and then start the curtain coating by pulling out the coating start plate 44 while moving the coating head 38 to the coating position.

The coating system according to the present invention is configured to use the automatic discriminating device 16, which is disposed in the coating line 12 for automatically discriminating at least the kinds of the coating heads 14 and 38, and select the operation sequence corresponding to the coating head 14 or 38, thereby, on the basis of the discrimination information discriminated by the automatic discriminating device 16, selecting the kinds of the coating heads 14 and 38 as well as the operation sequences with no error even when two or more kinds of the coating heads 14 and 38 are used in exchange in the single coating line 12. Accordingly, the coating system is capable of securely avoiding troubles due to misoperations and erroneous settings even when the coating heads are exchanged.

Furthermore, the coating system can be configured to be capable of updating information of coated semimanufactured goods representing portions which can be manufactured into products on the basis of the discrimination information and send the information to a next step, though portions that cannot be manufactured into products are prolonged at the coating start time and the coating termination time in case of the curtain coating method than those in the slide bead method or the like.

Though the embodiment has been described as an example where the two kinds of the coating heads for the slide bead coating and the curtain coating are exchanged, the present invention is not limited by the embodiment and the coating system according to the present invention can be configured to allow two or more kinds of coating heads to be exchanged with one another.

As described above, the coating system according to the present invention selects the kinds of the coating heads and the operating sequences with no errors even when two or more kinds of coating heads are exchanged in a single coating line.

Since the coating system does not cause an event where a coating head to be exchanged is erroneously selected or an erroneous operation sequence is selected for a correct coating head, the coating system is capable of not only performing proper coating corresponding to the currently set coating head but also preventing the coating heads from striking against the backup roller or the like, thereby avoiding breakage of appliances such as the coating heads and the backup roller.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A coating system, comprising:

a single coating line, configured to coat a running web with a coating liquid using a plurality of different kinds of coating heads in exchange;

an automatic discriminating device which automatically discriminates at least kinds of the plurality of coating heads, the automatic discriminating device being disposed in the coating line;

and a web driving device which moves said running web.

2. The coating system according to claim 1, wherein the automatic discriminating device comprises:

data carriers, each of which is disposed for each of the plurality of coating heads and has kind information of each of the plurality of coating heads; and a reading device which reads the information of the data carrier.

3. The coating system according to claim 2, wherein the reading device comprises a read/write antenna, and the information set in the data carrier with one of a microwave system and an optical system is noncontactly read by the read/write antenna.

4. The coating system according to claim 2, wherein each of the data carriers has coating condition information for each of the plurality of coating heads.

5. The coating system according to claim 4, wherein the reading device comprises a read/write antenna, and the information set in the data carrier with one of a microwave system and an optical system is noncontactly read by the read/write antenna.

6. The coating system according to claim 1, wherein the automatic discriminating device comprises:

bar codes, each of which is disposed for each of the plurality of coating heads and has at least kind information of each of the coating heads; and a bar code reader which reads information of the bar codes.

7. The coating system according to claim 1, wherein the automatic discriminating device comprises:

objects, each of which is disposed for each of the plurality of coating heads and has a form different dependently on each of the plurality of coating heads; and one of an electromagnetic proximity sensor, an ultrasonic sensor, a photoelectric sensor and a CCD camera which detects one of presence, absence and the form of the object.

8. The coating system according to claim 1, wherein the automatic discriminating device comprises:

one of an electromagnetic proximity sensor, an ultrasonic sensor, a photoelectric sensor and a CCD camera which determines forms of the plurality of coating heads.

9. The coating system according to claim 1, further comprising a control device which controls the coating line, the control device selecting an operation sequence corresponding to the automatically discriminated coating head out of a plurality of operation sequences according to an automatic discrimination result of the kind of the coating head set in the coating line.

10. The coating system according to claim 9, wherein the automatic discriminating device comprises:

data carriers, each of which is disposed for each of the plurality of coating heads and has kind information of each of the plurality of coating heads; and a reading device which reads the information of the data carrier.

11. The coating system according to claim 10, wherein the reading device comprises a read/write antenna, and the information set in the data carrier with one of a microwave system and an optical system is noncontactly read by the read/write antenna.

12. The coating system according to claim 10, wherein each of the data carriers has coating condition information for each of the plurality of coating heads.

13. The coating system according to claim 12, wherein the reading device comprises a read/write antenna, and the information set in the data carrier with one of a microwave system and an optical system is noncontactly read by the read/write antenna.

14. The coating system according to claim 9, wherein the automatic discriminating device comprises:

bar codes, each of which is disposed for each of the plurality of coating heads and has at least kind information of each of the coating heads; and a bar code reader which reads information of the bar codes.

15. The coating system according to claim 9, wherein the automatic discriminating device comprises:

objects, each of which is disposed for each of the plurality of coating heads and has a form different dependently on each of the plurality of coating heads; and one of an electromagnetic proximity sensor, an ultrasonic sensor, a photoelectric sensor and a CCD camera which detects one of presence, absence and the form of the object.

16. The coating system according to claim 9, wherein the automatic discriminating device comprises:

one of an electromagnetic proximity sensor, an ultrasonic sensor, a photoelectric sensor and a CCD camera which determines forms of the plurality of coating heads.

17. The coating system according to claim 9, wherein the control device comprises:

an input device which allows an operator to input the operation sequence; and a check mechanism which checks whether or not the operation sequence inputted through the input device correctly corresponds to the kind of the coating head automatically discriminated by the automatic discriminating device.

18. The coating system according to claim 17, wherein the automatic discriminating device comprises:

data carriers, each of which is disposed for each of the plurality of coating heads and has kind information of each of the plurality of coating heads; and a reading device which reads the information of the data carrier.

19. The coating system according to claim 18, wherein the reading device comprises a read/write antenna, and the information set in the data carrier with one of a microwave system and an optical system is noncontactly read by the read/write antenna.

20. The coating system according to claim 18, wherein each of the data carriers has coating condition information for each of the plurality of coating heads.

21. The coating system according to claim 20, wherein the reading device comprises a read/write antenna, and the information set in the data carrier with one of a microwave system and an optical system is noncontactly read by the read/write antenna.

22. The coating system according to claim 17, wherein the automatic discriminating device comprises:

bar codes, each of which is disposed for each of the plurality of coating heads and has at least kind information of each of the coating heads; and a bar code reader which reads information of the bar codes.

23. The coating system according to claim 17, wherein the automatic discriminating device comprises:

objects, each of which is disposed for each of the plurality of coating heads and has a form different dependently on each of the plurality of coating heads; and one of an electromagnetic proximity sensor, an ultrasonic sensor, a photoelectric sensor and a CCD camera which detects one of presence, absence and the form of the object.

24. The coating system according to claim 17, wherein the automatic discriminating device comprises:

one of an electromagnetic proximity sensor, an ultrasonic sensor, a photoelectric sensor and a CCD camera which determines forms of the plurality of coating heads.

* * * * *